US005878497A

United States Patent [19]

Seemann, III et al.

[11] Patent Number: 5,878,497

[45] Date of Patent: Mar. 9, 1999

[54] BOTTLE FOIL CUTTER

[76] Inventors: Joseph H. Seemann, III; Alfred Mall; Robert Mosteller, all of 7301 S.O.B. Trail, Orlando, Fla. 32809

[21] Appl. No.: 988,634

[22] Filed: Dec. 11, 1997

[51] Int. Cl.[6] ..... B67B 7/00

[52] U.S. Cl. ..... 30/1.5; 81/3.29

[58] Field of Search ..... 30/1.5; 81/3.09, 81/3.29, 3.35, 3.36, 3.48; 7/155, 156

[56] References Cited

U.S. PATENT DOCUMENTS 501,975 7/1893 Walker ..... 30/1.5
1,102,124 6/1914 Baptiste ..... 30/1.5
1,109,286 9/1914 Hagen ..... 30/1.5
2,227,421 1/1941 Bjork ..... 30/1.5

*Primary Examiner*—Hwei-Siu Payer

[57] ABSTRACT

A new bottle foil cutter for shearing foil or other material wraps on the necks of bottles. The inventive device includes a housing with an inner surface defining a bore through the housing, and a cutting member disposed within the bore. The inventive device is designed to be mounted onto a neck of a bottle and rotated so as to shear material wrap thereon. The inventive device can be coupled to and used in conjunction with a corkscrew apparatus.

13 Claims, 2 Drawing Sheets

FIG. 1
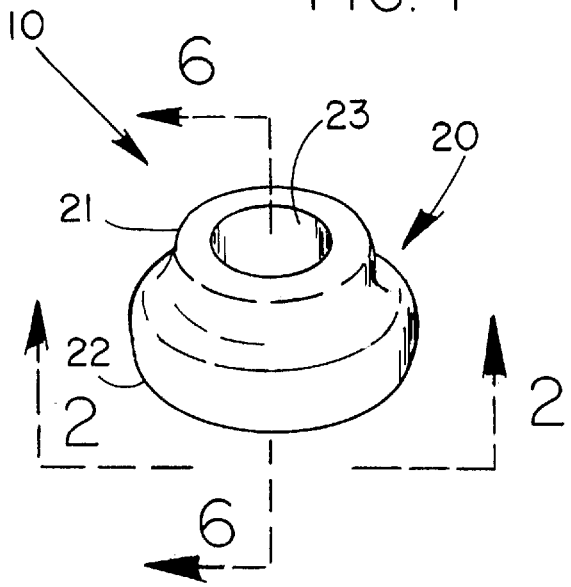
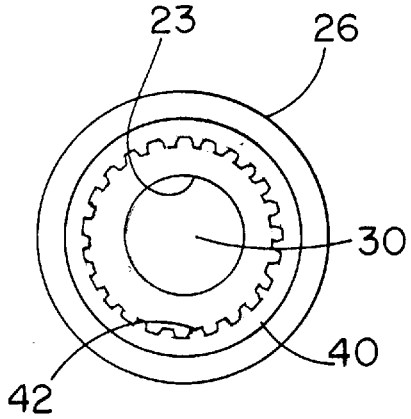
FIG. 2
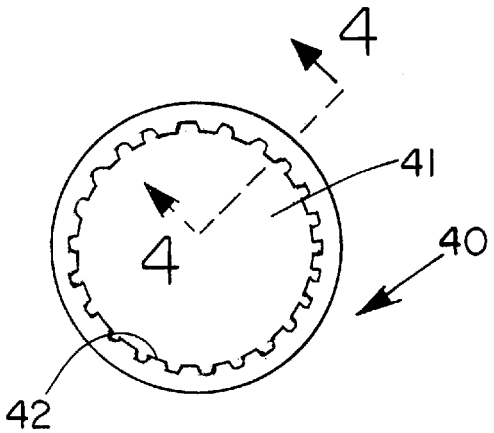
FIG. 3
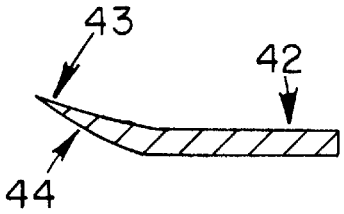
FIG. 4
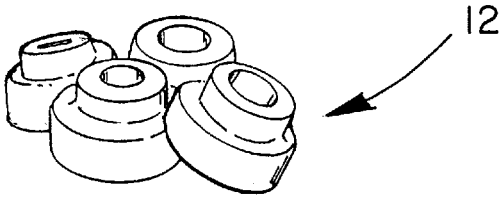
FIG. 5

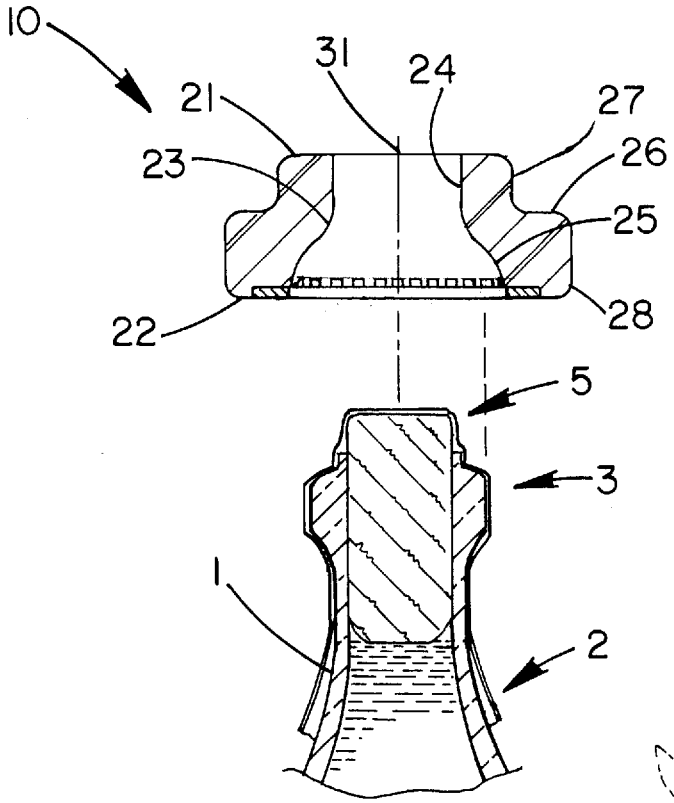
FIG. 6
FIG. 7
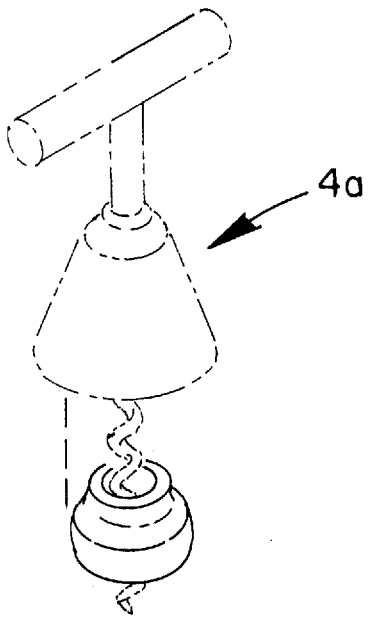
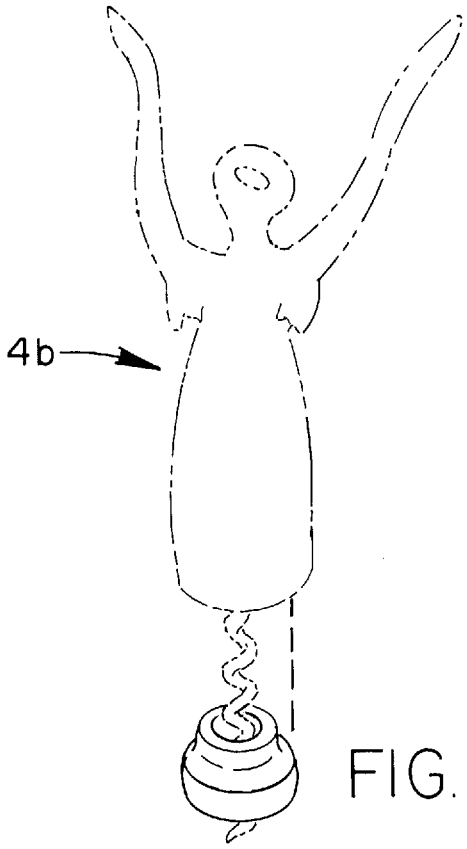
FIG. 8

BOTTLE FOIL CUTTER

BACKGROUND OF THE INVENTION

1. Field of the Invention

The present invention relates to devices for shearing foil or other material wraps on the necks of bottles and more particularly pertains to a new bottle foil cutter for shearing foil or other material wraps on the necks of bottles.

2. Description of the Prior Art

The use of devices for shearing foil or other material wraps on the necks of bottles is known in the prior art. More specifically, devices for shearing foil or other material wraps on the necks of bottles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,135,415; U.S. Pat. No. 4,276,789; U.S. Pat. No. 5,220,855; U.S. Pat. No. 4,765,206; and U.S. Pat. No. 5,363,725.

While these devices fulfill their respective, particular objectives and requirements, the aforementioned patents do not disclose a new bottle foil cutter. The inventive device includes a housing with an inner surface defining a bore through the housing, and a cutting member disposed within the bore.

In these respects, the bottle foil cutter according to the present invention substantially departs from the conventional concepts and designs of the prior art, and in so doing provides an apparatus primarily developed for the purpose of shearing foil or other material wraps on the necks of bottles.

SUMMARY OF THE INVENTION

In view of the foregoing disadvantages inherent in the known types of devices for shearing foil or other material wraps on the necks of bottles now present in the prior art, the present invention provides a new bottle foil cutter construction wherein the same can be utilized for shearing foil or other material wraps on the necks of bottles.

The general purpose of the present invention, which will be described subsequently in greater detail, is to provide a new bottle foil cutter apparatus and method which has many of the advantages of the devices for shearing foil or other material wraps on the necks of bottles mentioned heretofore and many novel features that result in a new bottle foil cutter which is not anticipated, rendered obvious, suggested, or even implied by any of the prior art devices for shearing foil or other material wraps on the necks of bottles, either alone or in any combination thereof.

To attain this, the present invention generally comprises a housing with an inner surface defining a bore through the housing, and a cutting member disposed within the bore.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bottle foil cutter apparatus and method which has many of the advantages of the devices for shearing foil or other material wraps on the necks of bottles mentioned heretofore and many novel features that result in a new bottle foil cutter which is not anticipated, rendered obvious, suggested, or even implied by any of the prior art devices for shearing foil or other material wraps on the necks of bottles, either alone or in any combination thereof.

It is another object of the present invention to provide a new bottle foil cutter which may be easily and efficiently manufactured and marketed.

It is a further object of the present invention to provide a new bottle foil cutter which is of a durable and reliable construction.

An even further object of the present invention is to provide a new bottle foil cutter which is susceptible of a low cost of manufacture with regard to both materials and labor, and which accordingly is then susceptible of low prices of sale to the consuming public, thereby making such bottle foil cutter economically available to the buying public.

Still yet another object of the present invention is to provide a new bottle foil cutter which provides in the apparatuses and methods of the prior art some of the advantages thereof, while simultaneously overcoming some of the disadvantages normally associated therewith.

Still another object of the present invention is to provide a new bottle foil cutter for shearing foil or other material wraps on the necks of bottles.

Yet another object of the present invention is to provide a new bottle foil cutter which includes a housing with an inner surface defining a bore through the housing, and a cutting member disposed within the bore.

Still yet another object of the present invention is to provide a new bottle foil cutter that shears foil or other material wraps on the necks of bottles.

Even still another object of the present invention is to provide a new bottle foil cutter that can be used in conjunction with a corkscrew apparatus to shear foil or other material wrap on the necks of bottles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new bottle foil cutter according to the present invention.

FIG. 2 is a bottom view of the present invention taken along line 2—2 of FIG. 1.

FIG. 3 is a top view of the internal cutting member/ring of the present invention.

FIG. 4 is a sectional view of a tooth taken along line 4—4 of FIG. 3.

FIG. 5 is a perspective view of a kit showing several bottle foil cutters each having a different sized inner diameter to fit various sized necks of bottles.

FIG. 6 is a sectional view of the housing taken along the line 6—6 of FIG. 1 shown in relation to a sectional view of a bottle.

FIG. 7 is an exploded perspective view of the present invention in combination with a wine waiter corkscrew shown in broken lines.

FIG. 8 is an exploded perspective view of the present invention in combination with a lever corkscrew shown in broken lines.

DESCRIPTION OF THE PREFERRED EMBODIMENT

With reference now to the drawings, and in particular to FIGS. 1 through 8 thereof, a new bottle foil cutter embodying the principles and concepts of the present invention and generally designated by the reference numeral 10 will be described.

As best illustrated in FIGS. 1 through 6, the bottle foil cutter 10 comprises a housing 20 with an inner surface 23 defining a bore 30 through the housing 20, and a cutting member 40 disposed within the bore 30. The bottle foil cutter 10 is designed for shearing material wrap 2, such as foil, plastic, or other material over the neck of a bottle 1.

The housing 20, as shown in FIG. 1, has an upper end 21 and a lower end 22. The housing inner surface 23 has an upper portion 24 and a circular lower portion 25. Preferably, the circumference of the inner surface lower portion 25 is larger than the perimeter of the inner surface upper portion 24. Ideally, both the inner surface upper portion 24 and the inner surface lower portion 25 are circular. The housing inner surface 23 defines a bore 30. The bore 30 extends through the housing from the lower end 22 to the upper end 21. The bore 30 is designed for accepting a portion of the neck of a bottle 1 into the housing lower end 22.

The outer surface 26 of the housing 20 has an upper portion 27 and a lower portion 28. Preferably, the perimeter of the outer surface lower portion 28 is larger than the circumference of the outer surface upper portion 27. Ideally, both the outer surface upper portion 27 has a shape and size approximating the upper portion 3 of a neck of a bottle 1 so that a corkscrew 4*a,b* adapted to rest on the top 5 of a bottle 1 will readily fit on the outer surface upper portion 27. In use, a wine waiter corkscrew 4*a* or a lever corkscrew 4*b* may be rested on the outer surface upper portion 27.

The cutting member 40 is preferably ring-shaped and has an inner opening 41 with a plurality of cutting teeth 42 extending radially inward from the cutting member 40 into the inner opening 41. Each cutting tooth 42 has a cutting edge 43 at its radially inner most portion 44. The cutting member 40 is coupled to the housing 20 and is disposed within the bore 30. Preferably, the cutting member 40 is positioned towards the housing lower end 22. Most preferably, the cutting member 40 is substantially aligned with the circumference of the housing inner surface lower portion 25. Ideally, the cutting member 40 is substantially centered on the central axis 31 of the bore 30.

In use, a bottle foil cutter 10 may be selected from a variety of sized inner openings 41 as provided by a kit 12 shown in FIG. 5. A properly sized bottle foil cutter 10 should be selected in order to correctly fit the neck of a bottle 1. The bottle foil cutter 10 is placed upon and mounted to the neck of a bottle 1 as shown in FIG. 6 by inserting the neck of the bottle 1 into the housing lower end 22. The cutting member inner opening 41 is positioned on the neck of a bottle 1 to abut the cutting teeth 42 against the material wrap 2. The bottle foil cutter 10 is rotated about the neck of the bottle 1 and the material wrap 2 is sheared by the movement of the cutting teeth 42 along the material wrap 2. Optionally, the bottle foil cutter 10 can be coupled to and used in conjunction with a corkscrew as shown in FIGS. 7 and 8.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bottle foil cutter for shearing foil or other material wraps on the necks of bottles, said bottle foil cutter comprising:

a housing having inner and outer surfaces, upper and lower ends, and a longitudinal axis extending between said upper and lower ends of said housing;

said inner surface of said housing defining a bore extending between said upper and lower ends of said housing, said bore being for inserting the neck of a bottle therein from said lower end of said housing;

said bore having a central axis generally coaxial with said longitudinal axis of said housing;

said bore having upper and lower portions, said upper portion of said bore being located adjacent said upper end of said housing, said lower portion of said bore being located adjacent said lower end of said housing;

said upper and lower portions of said bore each having diameter substantially perpendicular to said central axis of said bore;

said diameter of said upper portion of said bore being generally constant along said central axis of said bore such that said upper portion of said bore is generally cylindrical;

said diameter of said lower portion of said bore gradually increasing along said central axis of said bore in a direction from said upper portion of said bore towards said lower end of said housing such that said lower portion of said bore flares outwards from said upper portion of said bore and said lower portion of said bore has a generally arcuate side wall forming a concavity generally facing said lower end of said housing;

said lower portion of said bore being adapted for inserting a neck of a bottle therein from said lower end of said housing such that a lip around a mouth of the bottle is positioned in said bore;

said outer surface of said housing having generally disk-shaped top and bottom portions, said top portion of said outer surface being located adjacent said upper end of said housing, said bottom portion of said outer surface being located adjacent said lower end of said housing;

said top and bottom portions of said outer surface each having a diameter, said diameter of said top portion being less than said diameter of said bottom portion such that said top and bottom portions of said outer surface form an annular shoulder around said housing;

said top portion of said outer surface having a diameter adapted for permitting insertion of said top portion of said outer surface into a ring shaped portion of a housing of a corkscrew such that said housing is held to the housing of the corkscrew an annular cutting member being provided in said bore, said cutting member having a generally circular outer perimeter coupled to said housing and a plurality of cutting teeth extending radially inwards towards said central axis of said bore, each of said cutting teeth having a cutting edge;

said outer perimeter of said cutting member generally lying in a common plane with said lower end of said housing such that that the lip around the mouth of a bottle inserted into said bore through said lower end of said housing is positioned above said outer perimeter of said cutting member;

said cutting teeth each curving upwards in a direction towards said upper end of said housing with each of said cutting teeth having a concavity facing towards said upper end of said housing such that said cutting edges of said cutting teeth are positioned above said outer perimeter of said cutting member in said bore for optimally cutting into the foil wrapping covering the neck of a bottle and for helping pull the cut foil wrapping away from the neck of the bottle as said housing is lifted off of the neck of the bottle; and each of said cutting teeth having a generally rectangular outer configuration for maximizing the area of contact between said cutting teeth and the foil wrapping covering the neck of a bottle when said housing is rotated back and forth between clockwise and counter-clockwise directions about said center axis of said bore.

2. A bottle foil cutter for shearing foil or other material wraps on the necks of bottles, said bottle foil cutter comprising:

a housing having an upper end, a lower end, an inner surface, and an outer surface, said housing inner surface having a lower portion and an upper portion, said housing inner surface lower portion having a circumference, said housing inner surface upper portion having a circumference, said housing inner surface lower portion circumference being greater than said housing inner surface upper portion circumference, said outer surface having an upper portion and a lower portion, said housing outer surface lower portion having a circumference, said housing outer surface upper portion having a circumference, said housing outer surface lower portion circumference being greater than said housing outer surface upper portion circumference, said housing outer surface upper portion being for mounting to a corkscrew;

said inner surface defining a bore, said bore having a central axis, said bore being extended through said housing from said housing lower end to said housing upper end, said bore being for inserting the neck of a bottle therein from said housing lower end; and a ring-shaped cutting member having an inner opening and a plurality of cutting teeth being extended radially towards said cutting member inner opening, each said cutting member cutting teeth having a cutting edge, said cutting member being disposed within said bore, said cutting member being coupled to said housing, said cutting member being positioned towards said housing lower end, said cutting member being substantially aligned with said inner surface lower portion circumference, said cutting member inner opening being substantially centered on said bore central axis, said cutting member inner opening being for inserting the neck of a bottle therethrough, said cutting edge being for shearing the foil wrapping covering the neck of a bottle;

said cutting teeth each curving upwards in a direction towards said upper end of said housing with each of said cutting teeth having a concavity facing towards said upper end of said housing such that said cutting edges of said cutting teeth are located in said bore between said upper and lower ends of said housing for optimally cutting into the foil wrapping covering the neck of a bottle and for helping pull the cut foil wrapping away from the neck of the bottle as said housing is lifted off of the neck of the bottle;

each of said cutting teeth having a generally rectangular outer configuration for maximizing the area of contact between said cutting teeth and the foil wrapping covering the neck of a bottle when said housing is rotated back and forth between clockwise and counter-clockwise directions about a longitudinal axis extending between said upper and lower ends of said housing.

3. A bottle foil cutter for shearing foil or other material wraps on the necks of bottles, said bottle foil cutter comprising:

a housing having an upper end, a lower end and an inner surface;

said inner surface defining a bore, said bore being extended through said housing from said housing lower end to said housing upper end, said bore being for inserting the neck of a bottle therein from said housing lower end;

a ring-shaped cutting member having an inner opening and a plurality of cutting teeth being extended radially towards said cutting member inner opening, said cutting member being disposed within said bore, said cutting member inner opening being for inserting the neck of a bottle therethrough, said cutting teeth being for shearing the foil wrapping covering the neck of a bottle;

each of said cutting teeth tapering radially inwards to a cutting edge;

said cutting teeth each curving upwards in a direction towards said upper end of said housing with each of said cutting teeth having a concavity facing towards said upper end of said housing such that said cutting edges extend in a direction towards said upper end of said housing for optimally cutting into the foil wrapping covering the neck of a bottle and for helping pull the cut foil wrapping away from the neck of the bottle as said housing is lifted off of the neck of the bottle; and each of said cutting teeth having a generally rectangular outer configuration for maximizing the area of contact between said cutting teeth and the foil wrapping covering the neck of a bottle when said housing is rotated back and forth between clockwise and counterclockwise directions about a longitudinal axis extending between said upper and lower ends of said housing.

4. The bottle foil cutter of claim 3, wherein said housing is adapted for mounting to a corkscrew.

5. The bottle foil cutter of claim 4, wherein said housing has an outer surface, said outer surface having an upper portion and a lower portion, said outer surface upper portion being adapted for mounting to a corkscrew.

6. The bottle foil cutter of claim 5, wherein said housing outer surface upper portion has a circumference and said housing outer surface lower portion has a circumference.

7. The bottle foil cutter of claim 6, wherein said housing outer surface lower portion circumference is greater than said housing outer surface upper portion circumference.

8. The bottle foil cutter of claim 3, wherein said cutting member is coupled to said housing.

9. The bottle foil cutter of claim 3, wherein said cutting member is positioned towards said housing lower end.

10. The bottle foil cutter of claim 3, wherein said housing inner surface has an upper portion and a lower portion, said housing inner surface lower portion having a circumference, and said housing inner surface upper portion having a circumference.

11. The bottle foil cutter of claim 10, wherein said housing inner surface lower portion circumference is greater than said housing inner surface upper portion circumference.

12. The bottle foil cutter of claim 10, wherein said cutting member is substantially aligned with said inner surface lower portion circumference.

13. The bottle foil cutter of claim 3, wherein said bore has a central axis, and wherein said cutting member inner opening is substantially centered on said bore central axis.

* * * * *